US006779538B2

(12) United States Patent
Morgante et al.

(10) Patent No.: US 6,779,538 B2
(45) Date of Patent: Aug. 24, 2004

(54) ERECTABLE, COLLAPSIBLE SHELTER

(75) Inventors: Dominic Morgante, East Keilor (AU); Fred Blochlinger, Toorak (AU); Mark Johnson, Richmond (AU); Mick Kusel, Essendon (AU); Nicholas Mark Reginald Pritchard, Braeside (AU)

(73) Assignee: Gale Pacific Limited, Victoria (AU)

( * ) Notice: Subject to any disclaimer, the term of this patent is extended or adjusted under 35 U.S.C. 154(b) by 115 days.

(21) Appl. No.: 09/948,999

(22) Filed: Sep. 7, 2001

(65) Prior Publication Data

US 2002/0074031 A1 Jun. 20, 2002

(30) Foreign Application Priority Data

Sep. 7, 2000 (AU) ..... PQ9959

(51) Int. Cl.[7] ..... E04H 15/46; E04H 15/52

(52) U.S. Cl. ..... 135/128; 135/143; 135/160; 135/144

(58) Field of Search ..... 135/122, 128, 135/130, 131, 136, 139–145, 158, 160

(56) References Cited

U.S. PATENT DOCUMENTS

| | | | | | |
|---|---|---|---|---|---|
| 957,215 | A | * | 5/1910 | Juin | 135/139 |
| 1,449,894 | A | * | 3/1923 | Dial | 135/98 |
| 2,723,673 | A | * | 11/1955 | Call | 135/140 |
| 4,607,656 | A | | 8/1986 | Carter | 135/110 |
| 5,275,188 | A | | 1/1994 | Tsai | 135/97 |
| 5,421,356 | A | | 6/1995 | Lynch | 135/145 |
| 5,511,572 | A | | 4/1996 | Carter | 135/145 |
| 5,638,853 | A | | 6/1997 | Tsai | 135/145 |
| 5,701,923 | A | | 12/1997 | Losi, Jr. et al. | 135/131 |
| 5,934,301 | A | * | 8/1999 | Carter | 135/145 |
| 5,944,040 | A | * | 8/1999 | Jang | 135/126 |
| 6,035,877 | A | * | 3/2000 | Losi et al. | 135/131 |
| 6,070,604 | A | | 6/2000 | Carter | 135/145 |
| 6,089,247 | A | | 7/2000 | Price | 135/145 |
| 6,173,726 | B1 | * | 1/2001 | Talmadge | 135/144 |
| 6,216,717 | B1 | * | 4/2001 | Chen | 135/130 |
| 6,283,136 | B1 | * | 9/2001 | Chen | 135/144 |
| 6,374,843 | B1 | * | 4/2002 | Zou | 135/145 |
| 6,382,244 | B2 | * | 5/2002 | Vann | 137/515 |
| 6,470,902 | B1 | * | 10/2002 | Carter | 135/145 |
| 6,502,597 | B2 | * | 1/2003 | Carter | 135/145 |
| 2002/0018659 | A1 | * | 2/2002 | Carter | 135/145 |
| 2002/0059948 | A1 | * | 5/2002 | Carter | 135/121 |

FOREIGN PATENT DOCUMENTS

| | | | |
|---|---|---|---|
| AU | 684978 | 2/1994 | E04H/15/58 |
| AU | 722814 | 9/1997 | E04H/15/50 |
| AU | 2082397 | 11/1998 | E04H/15/38 |
| DE | 299 08 519 U1 | 9/1999 | |
| WO | WO 94/23162 | 10/1994 | |
| WO | WO 96/03560 | 2/1996 | |
| WO | WO 97/33059 | 9/1997 | |
| WO | WO 00/08276 | 2/2000 | |
| WO | WO 00/08277 | 2/2000 | |
| WO | WO0008278 A1 | 2/2000 | E04H/15/50 |
| WO | WO 00/15929 | 3/2000 | |

* cited by examiner

*Primary Examiner*—Robert Canfield
(74) *Attorney, Agent, or Firm*—Ohlandt, Greeley, Ruggiero & Perle

(57) ABSTRACT

An erectable, collapsible frame (2) for a shelter (1), the frame (2) being erectable to support a canopy (3) in order to form the shelter. The frame (2) includes at least 3 legs (4), and a perimeter support assembly (12) extending between and interconnecting adjacent legs (4). A canopy peak support assembly (28) extends outwardly from the legs (4), when the frame (2) is erected, to define an underlying shelter space (S). The legs (4) and support assemblies (12,28) are pivotably interconnected to enable unfolding and folding for respective erection and collapse of the frame (2).

A shelter (1) incorporating the frame (2) and canopy (3) is also disclosed.

42 Claims, 12 Drawing Sheets

ERECTABLE, COLLAPSIBLE SHELTER

FIELD OF THE INVENTION

This invention relates generally to portable shelters and, in particular, to a portable shelter which can be readily unfolded for erection when required for use and folded for storage and transportation when not in use, as well as a frame for such a shelter. The invention is applicable to providing temporary shade and other shelter for outdoor gatherings and other activities, and it will be convenient to hereinafter disclose the invention in relation to that exemplary application. However, it is to be appreciated that the invention is not limited to that application.

BACKGROUND OF THE INVENTION

The following discussion of the background to the invention is intended to facilitate an understanding of the present invention. However, it should be appreciated that the discussion is not an acknowledgement or admission that any of the material referred to was published, known or part of the common general knowledge in Australia as at the priority date of the application.

One form of erectable, collapsible shelter, includes a frame having at least three legs, and a perimeter truss linkage assembly connected to the legs so as to form a perimeter roof eave of the shelter when erected. A canopy peak support assembly is also connected to the legs and can extend above the top of those legs when the shelter is erected so that the perimeter linkage assembly and canopy peak support assembly together support a canopy extending over the frame.

The shelter frame is connected together so that it can be unfolded for erection and folded for storage and transport.

In one shelter form, the perimeter truss linkage assembly includes pairs of truss links extending along an eave line of the shelter between upper ends of adjacent legs. The truss links of each pair are pivotably connected together intermediate their ends in a scissors configuration. Moreover, the truss links are pivotably connected to respective legs. In this way, the truss links can pivot relative to one another, and relative to the legs, for folding and unfolding of the perimeter linkage assembly.

In this form of shelter, the canopy peak support assembly includes support rods extending from each of the legs to a centrally located peak bracket. The rods are pivotably connected to the legs and bracket. In addition, each rod has sections which pivot or telescope relative to one another. In this way, the support rods can pivot, and perhaps also slide, to effect folding and unfolding of the canopy peak support assembly.

The shelter incorporates a fabric or other flexible sheet material canopy which fits over at least the canopy peak support assembly and perimeter truss linkage assembly. The canopy assists in maintaining the frame rigid and stable when the shelter is erected. The canopy may be permanently fitted to the frame for folding and unfolding therewith, or may be removable from the frame for collapsing.

Examples of this form of shelter are disclosed in Australian patents 684978 and 722814, and patent application 49813/99.

One problem with this form of shelter is the overall height of the perimeter truss linkage assembly. The scissor configuration of the truss links results in those links extending downwardly a considerable distance from the eave line. That tends to reduce the headroom available for access to the shelter, particularly midway between adjacent legs.

In an effort to increase that headroom, the truss linkage assembly has been modified by introducing further scissor-type links. One example of a shelter having that modified linkage assembly is disclosed in Australian patent application 20823/97.

The inclusion of the additional links in the linkage assembly adds to its complexity and attendant difficulty of pivoting those links during folding and unfolding of the shelter frame. Moreover, the modified linkage assembly tends to add to the overall cost of the shelter.

SUMMARY OF THE INVENTION

It is an object of the present invention to provide a simple shelter frame which will easily unfold for rigid and stable erection, and fold for compact storage and transport.

A further object of the present invention is to provide a shelter frame which enables improved headroom access into an erected shelter.

Another object of the present invention is to provide an aesthetically attractive shelter which can be readily erected and collapsed.

A further object of the present invention is to provide an erectable, collapsible shelter which, when erected, has easy access and clear interior usable space.

According to one broad aspect of the present invention, there is provided an erectable, collapsible frame for a shelter, the frame being erectable to support a canopy thereon in order to form a shelter, the frame including:

(a) at least 3 legs;

(b) a perimeter support assembly extending between and interconnecting adjacent legs; and (c) a canopy peak support assembly extending outwardly from the legs, when the frame is erected, to define an underlying shelter space;

wherein the legs and support assemblies are pivotably interconnected to enable unfolding and folding for respective erection and collapse of the frame.

The perimeter support assembly preferably includes elongate perimeter support members. Each perimeter support member preferably extends between and is connected to a respective pair of adjacent legs. Each perimeter support member preferably has on an eave line extending between the connections of the perimeter support members with the legs, when the frame is erected. The perimeter support members are preferably connected to upper ends of the legs and do not project beneath the eave line when the frame is erected.

Preferably, each perimeter support member is pivotably connected to the respective legs. Moreover, each connection permits pivotal movement of the perimeter support member only in a downward direction between the legs during frame collapse and only in an upward direction during frame erection.

In at least one preferred form, each perimeter support member includes at least two sections. All of the sections of each perimeter support member are arranged end-to-end, and the sections are interconnected for relative pivotal movement for unfolding and folding during frame erection and collapse, respectively. In the preferred form, the sections of each perimeter support member are pivotably interconnected so that the sections fold inwardly between the legs connected thereto so as to draw the legs together during frame collapse.

Preferably, the perimeter support assembly includes stabilising members extending between and connected to the perimeter support members and legs to releasably fix the support members and legs relative to one another when unfolded to achieve rigid, stable erection of the frame. The stabilising members are preferably actuable to release the support members and legs for relative folding in order to collapse the frame.

In at least one preferred form, each stabilising member is elongate with opposed ends. One end of the stabilising member is connected to a respective perimeter support member and the other end being connected to an associated leg beneath the connection of the perimeter support member with the leg so as to fix the support members relative to the legs. The connections are movable or removable, in this preferred form, to accommodate relative movement of the perimeter support members and legs for folding and unfolding.

The canopy peak support assembly preferably includes elongate canopy peak support members. Each member has opposed ends, one of which is connected to an associated leg with the other end being interconnected with the other end of at least one other canopy peak support member. Preferably, the canopy peak support members are pivotably connected to the legs and pivotably connected to one another. Those connections permit pivotal movement of the canopy peak support members between a folded position extending inwardly between the legs, and an unfolded position extending above the legs and over the shelter space.

Preferably, the canopy peak support assembly includes stabilising members extending between each canopy peak support member and the associated leg to releasably fix the canopy peak support members and legs relative to one another when unfolded to achieve rigid, stable erection of the frame. The stabilising members are preferably actuable to release the canopy peak support members and legs for folding in order to collapse the frame.

Preferably, each leg includes at least two leg sections movable relative to one another between a full length condition adopted when the frame is erected, and a reduced length condition adopted when the frame is collapsed. In at least one preferred form, the leg sections of each leg are telescopically interconnected for relative sliding movement one within an other in order to adjust the leg length.

Preferably, each leg includes a locking mechanism for rigidly locking the leg sections together when moved to the full length condition. The mechanisms are preferably actuable to release the leg sections for relative movement to the reduced leg length condition.

According to one specific aspect of the present invention, there is provided an erectable, collapsible frame for a shelter, the frame being erectable to support a canopy thereon in order to form a shelter, the frame including:

(a) at least 3 legs;

(b) a perimeter support assembly extending between and interconnecting adjacent legs at upper ends thereof, the perimeter support assembly including:

(i) one only perimeter support rod extending between each pair of legs, each perimeter support rod having at least two elongate rod sections arranged end-to-end, one end of a respective rod section being pivotably connected to a respective leg and the other ends of the rod sections of each perimeter support rod being pivotably connected one to another, the legs and support rods being pivotable between an unfolded position in which the support rods extend on an eave line between the upper ends of the legs, and a folded position in which the rod sections of the support rods and the legs extend generally side-by-side one another, and (ii) a respective stabilising strut extending between a respective support rod section and an associated leg, each stabilising strut having opposed ends, one end being connected to the respective support rod section and the other end being connected to the associated leg beneath the upper end thereof, the stabilising struts releasably fixing the perimeter support rods and legs relative to one another in their unfolded position, and being actuable to release the support rods and legs for folding into their folded position; and (c) a canopy peak support assembly extending above the legs when the frame is erected to define an underlying shelter space, the canopy peak support assembly being foldable and unfoldable;

wherein unfolding and folding of the legs, perimeter support rods and the canopy peak support assembly, respectively, erecting and collapsing the frame.

According to another specific aspect of the present invention there is provided an erectable, collapsible frame for a shelter, the frame being erectable to support a canopy thereon in order to form a shelter, the frame including:

(a) at least 3 legs;

(b) a perimeter support assembly extending between and interconnecting adjacent legs at upper ends thereof, the perimeter support assembly being foldable and unfoldable; and (c) a canopy peak support assembly including:

(i) a canopy peak support rod associated with each leg, each canopy peak support rod having two elongate rod sections with opposed ends, one end of one rod section of each support rod being pivotably connected to the upper end of the associated leg, one end of the other rod sections being pivotably connected one to another, and the other end of the one rod section of each support rod being pivotably connected to the other rod section between the ends of the other rod section, the legs and support rods being pivotable between an unfolded position in which the support rods extend above the upper ends of the legs and over shelter space defined by the frame, and a folded position in which the rod sections of the support rods and the legs extend generally side-by-side one another;

(ii) a respective stabilising stay extending between each canopy peak support rod and the associated leg, each stabilising stay having opposed ends, one end being connected to the associated leg and the other end being connected to the other end of the other rod section of the canopy peak support rod; and (iii) a respective stabilising strut extending between each stabilising stay and the associated leg, each stabilising strut having opposed ends, one end being connected to the associated leg and the other end being connected to the stabilising stay intermediate the ends thereof, the stabilising struts releasably fixing the canopy peak support rods, stabilising stays, and legs relative to one another in their unfolded position, and being actuable to release the canopy peak support rods and legs for folding into their folded position;

wherein unfolding and folding of the legs, perimeter support assembly and the canopy peak support rods, respectively, erecting and collapsing the frame.

In another broad aspect, the present invention provides an erectable and collapsible shelter including the above frame, and a canopy extending over and supported by the perimeter and peak support assemblies when the shelter is erected.

DESCRIPTION OF THE PREFERRED EMBODIMENT

The following description refers to preferred embodiments of the shelter and frame of the present invention. To facilitate an understanding of the invention, reference is made in the description to the accompanying drawings where the shelter and frame are illustrated. It is to be understood that the invention is not limited to the embodiments as hereinafter described and as illustrated.

In the drawings, where the same reference numerals identify the same or similar components:

Figure 1:
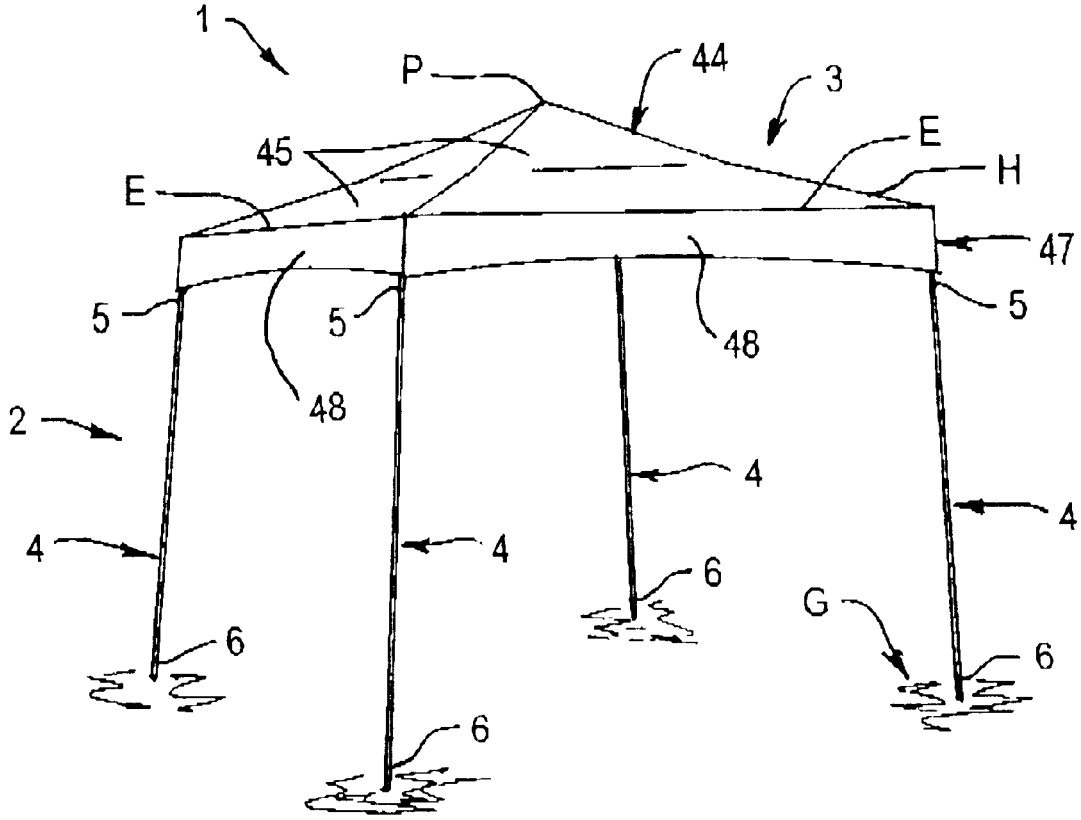
FIG. 1 is a perspective view of an erected shelter according to one embodiment of the present invention.
Figure 2:
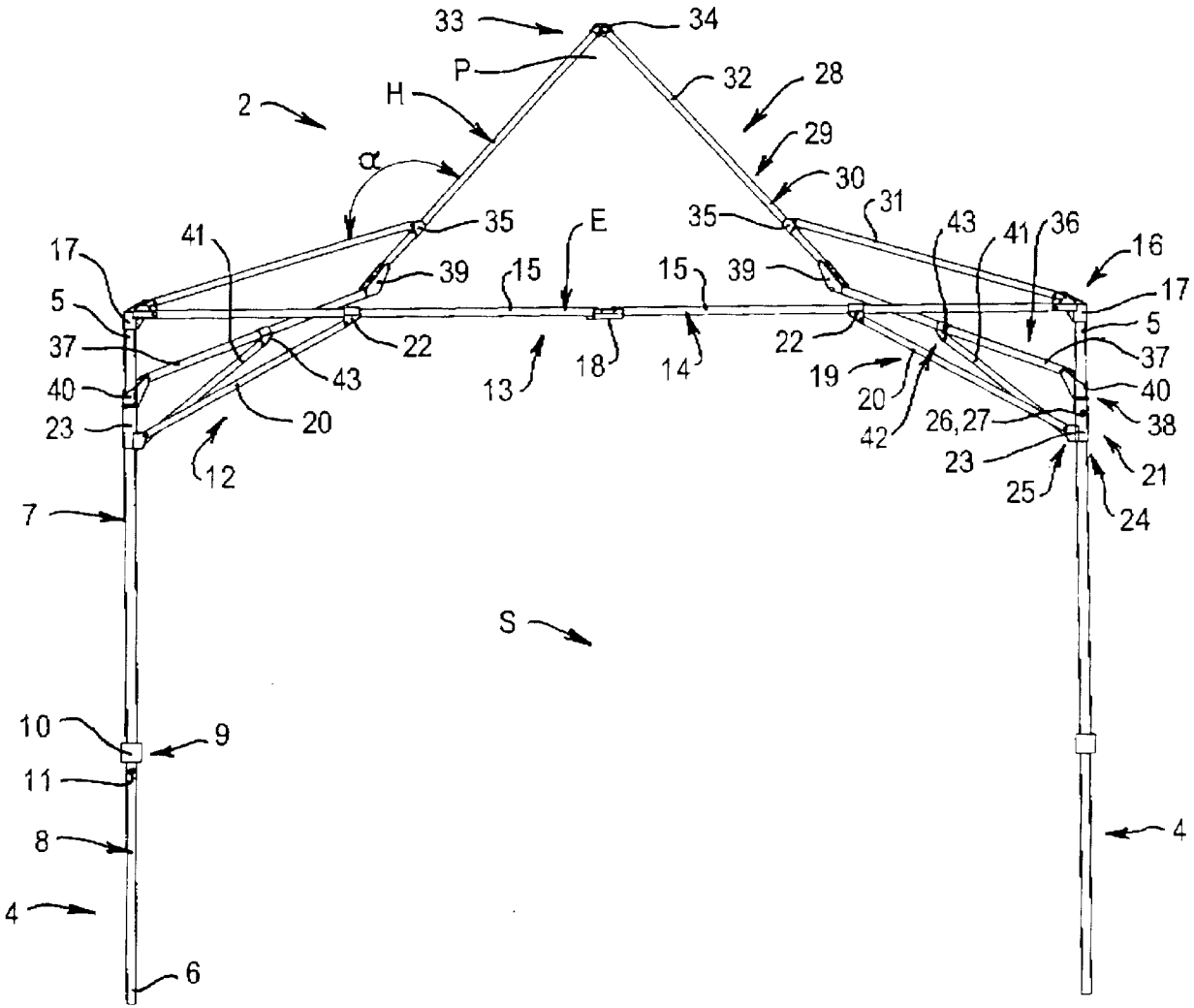
FIG. 2 is one side view of a shelter frame according to one embodiment of the present invention for the shelter of FIG. 1 and showing the frame fully erected.
Figure 3:
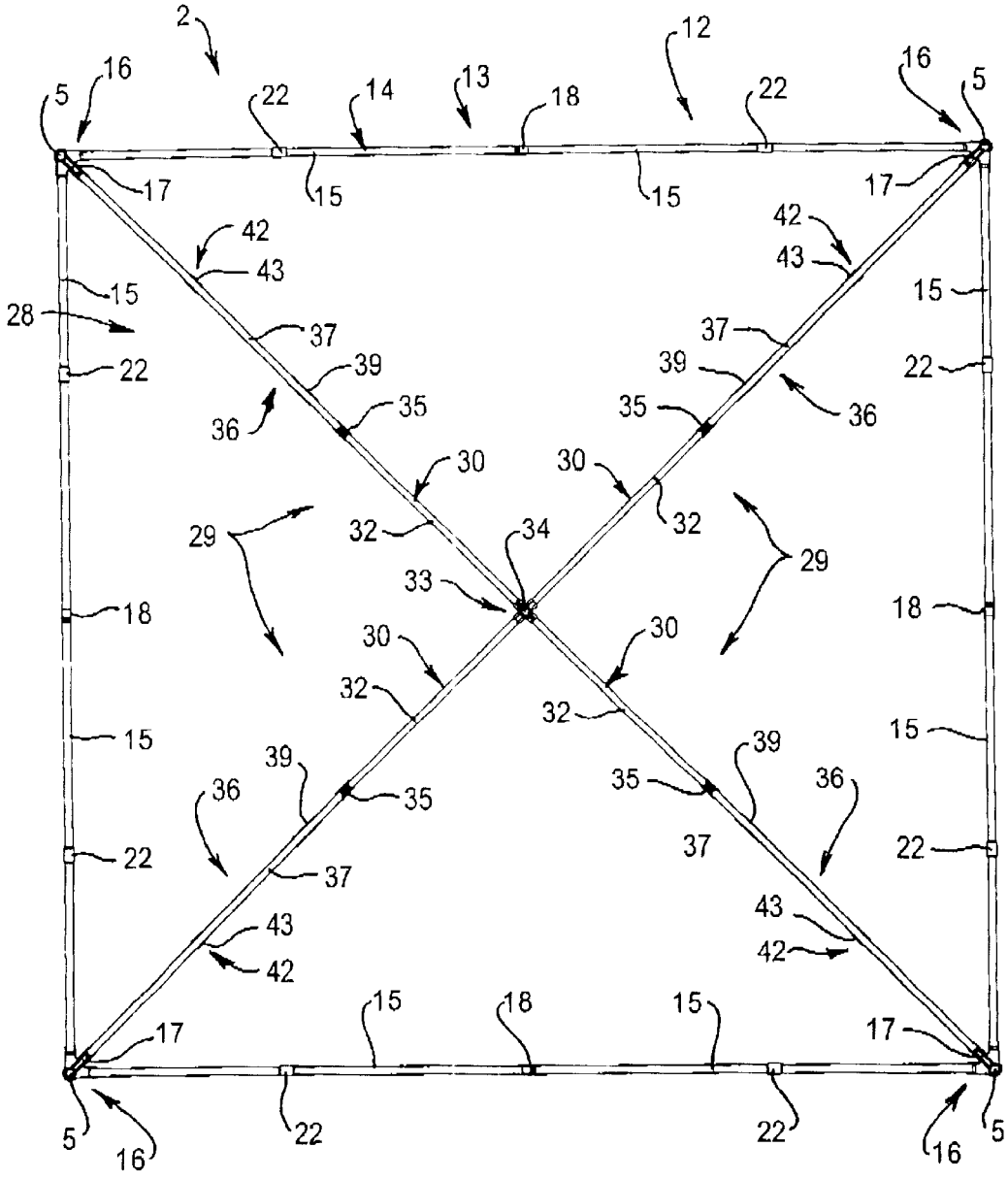
FIG. 3 is a top view of the shelter frame of FIG. 2.
Figure 4:
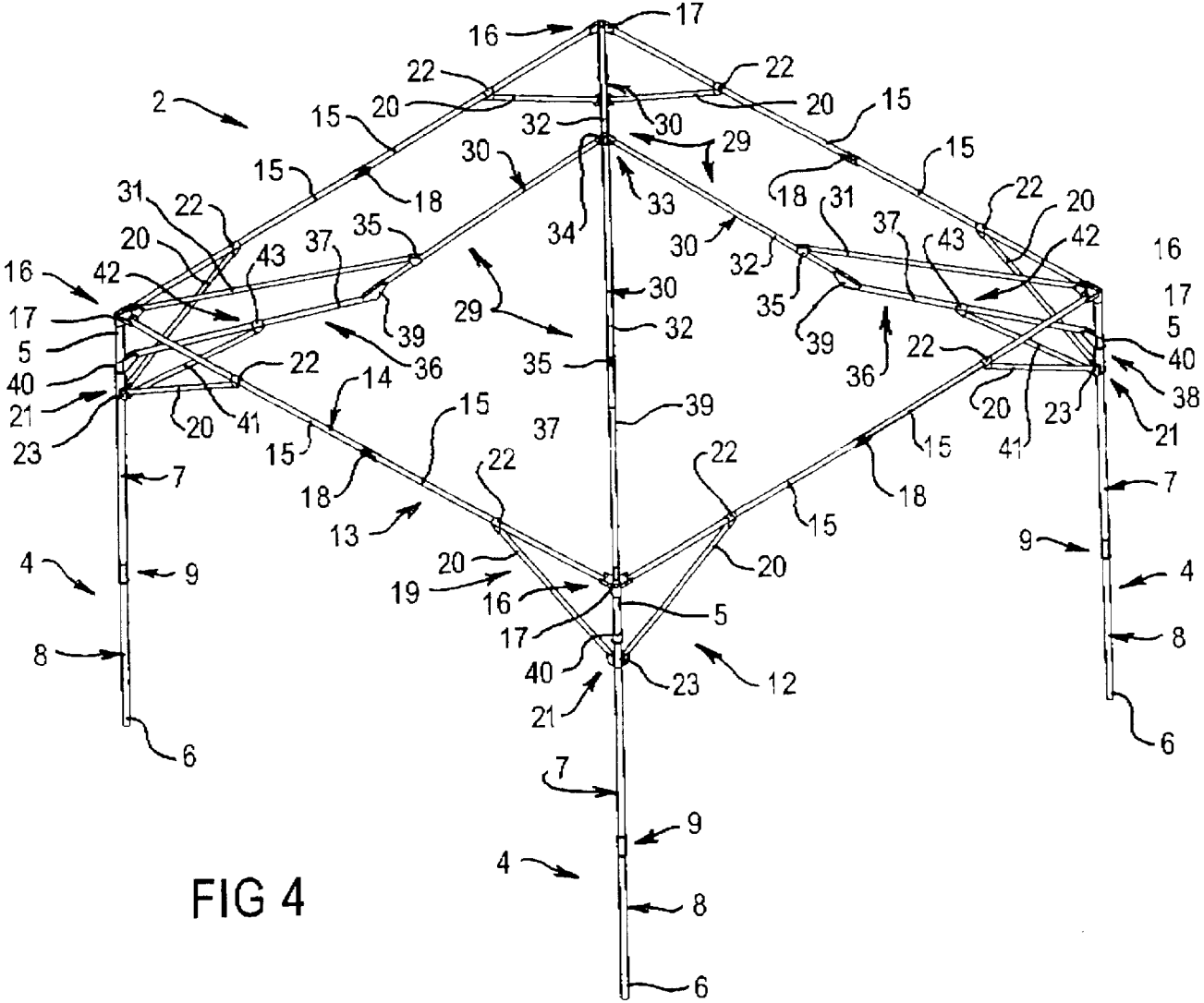
FIG. 4 is a perspective view of the shelter frame of FIG. 2.
Figure 5:
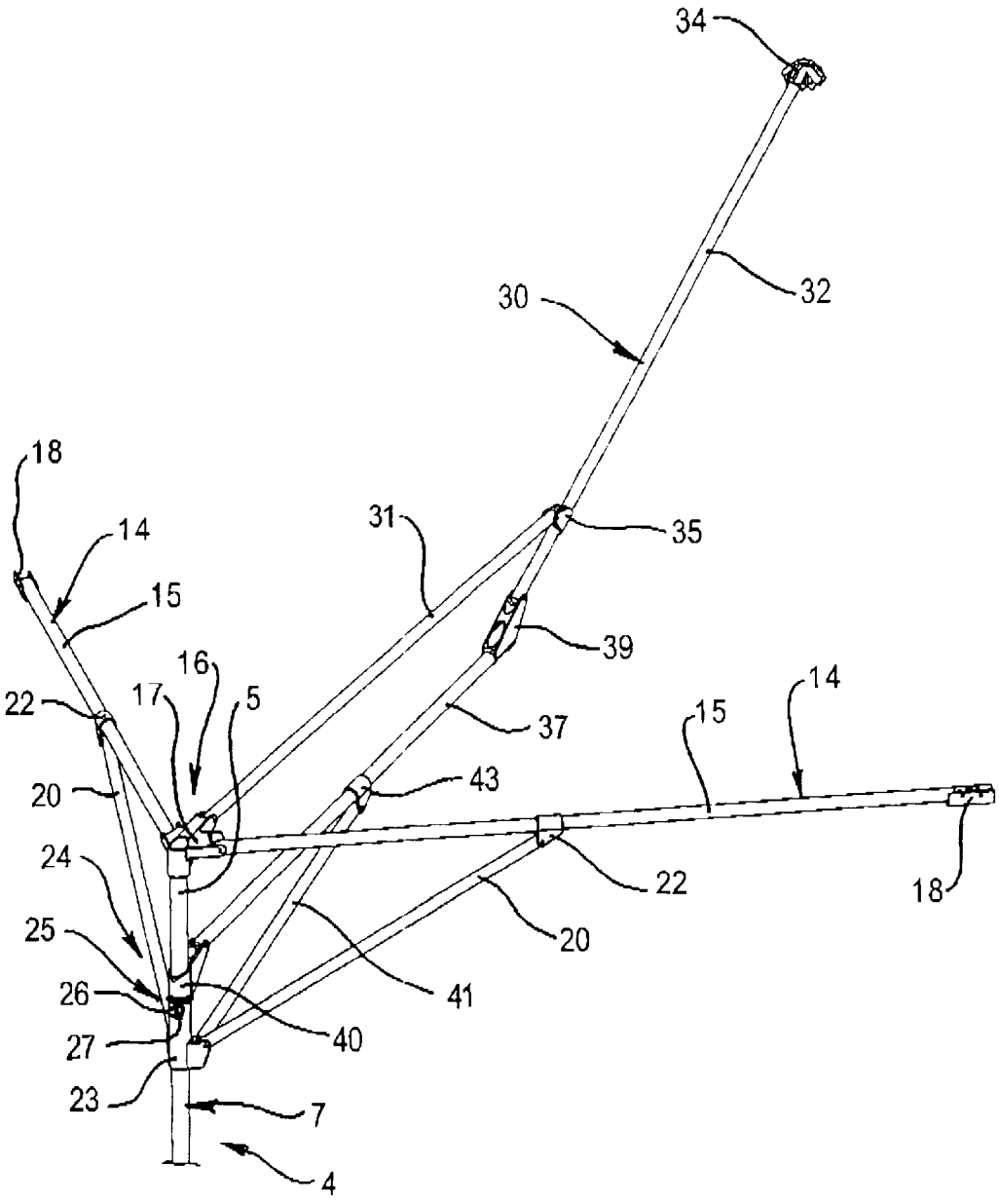
FIG. 5 is a detailed perspective view of part of the shelter frame of FIG. 2.
Figure 8:
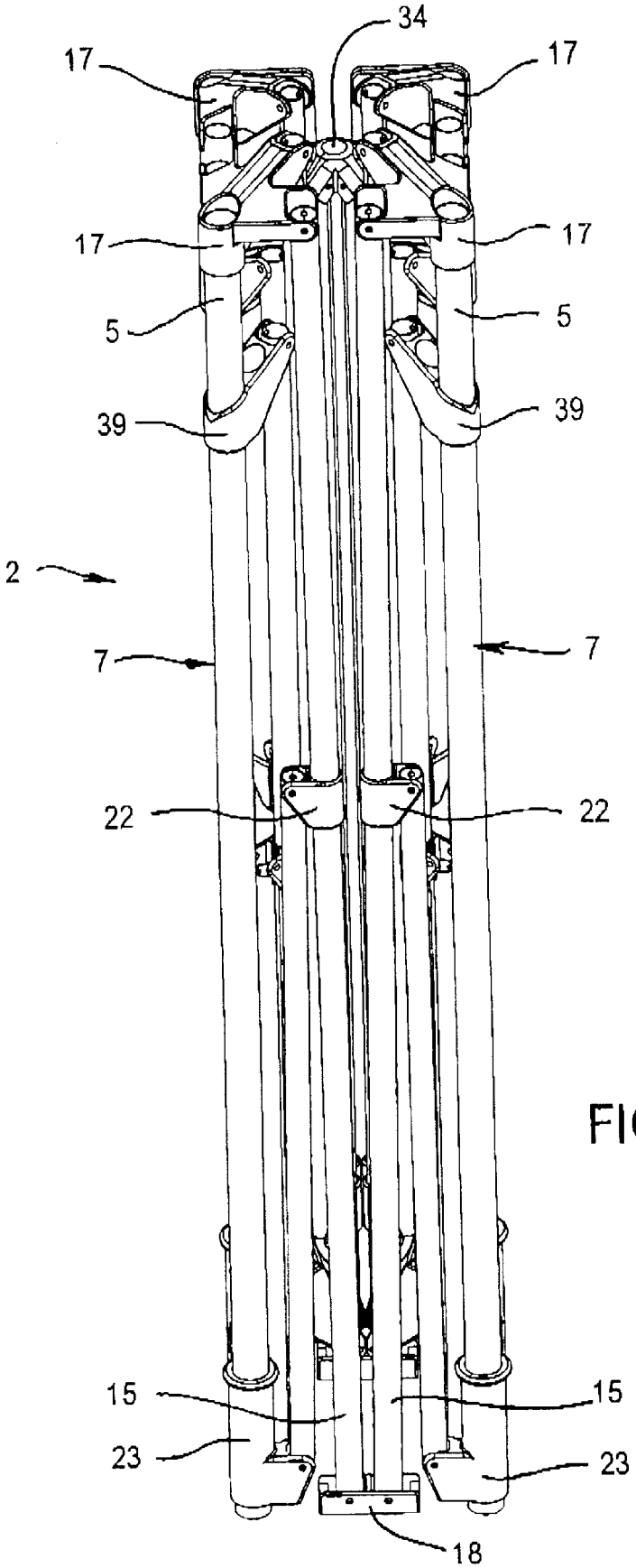
FIG. 8 is a side view of the shelter frame similar to FIG. 6 but showing the frame fully collapsed.
Figure 9:
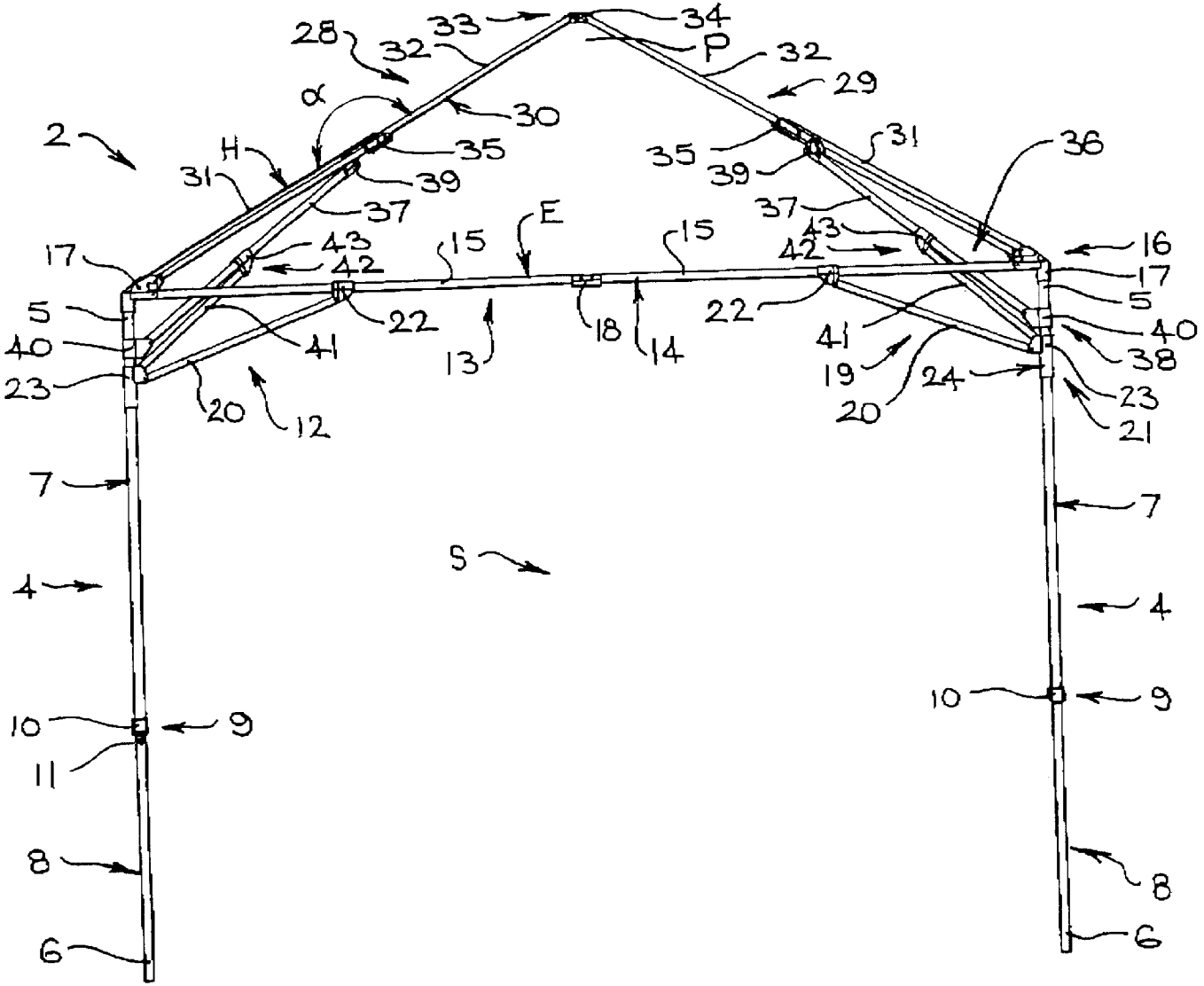
FIG. 9 is one side view of a shelter frame according to another embodiment of the present invention and showing the frame fully erected.
Figure 10:
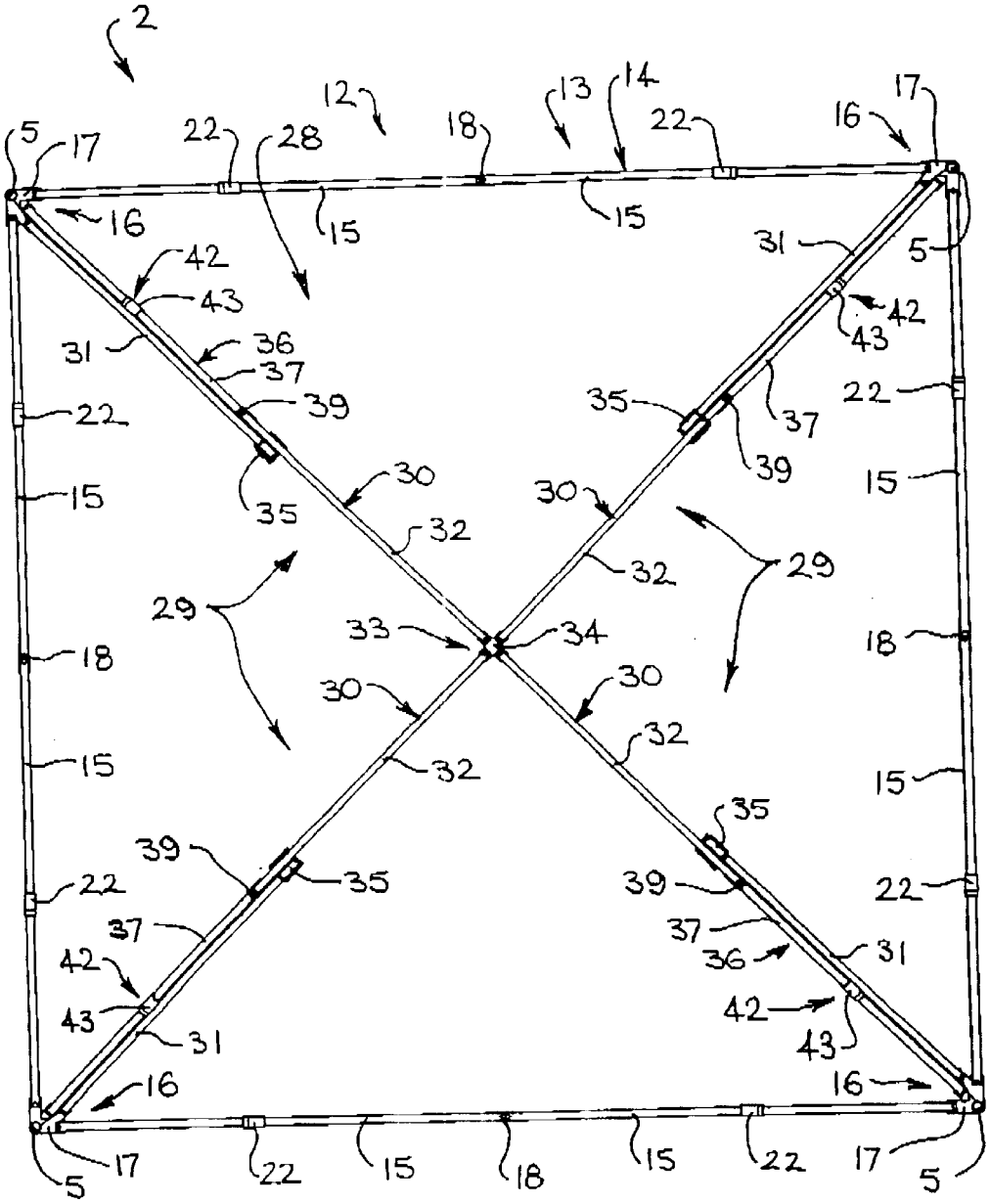
FIG. 10 is a top view of the shelter frame of FIG. 9.
Figure 11:
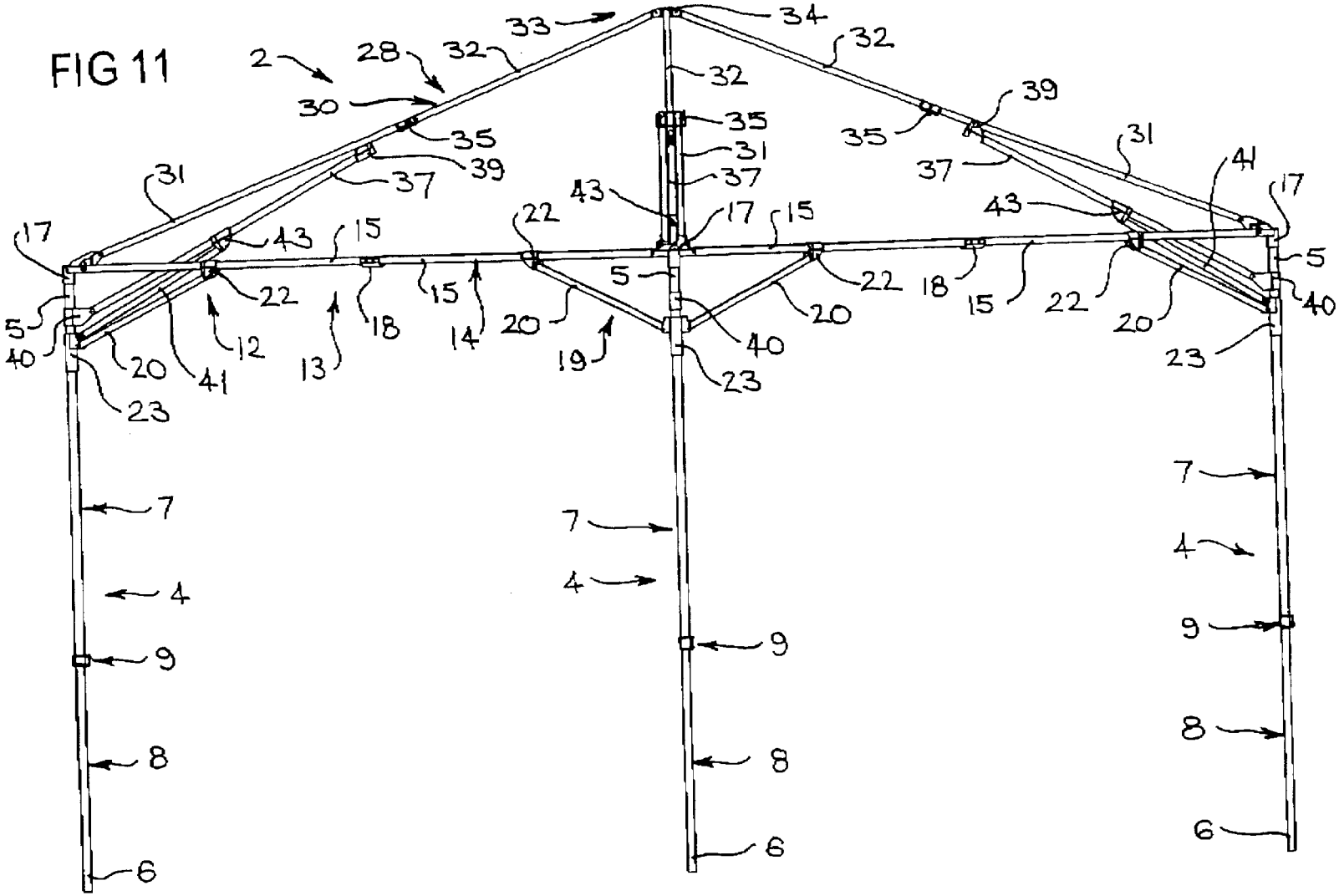
FIG. 11 is a different side view of the shelter frame of FIG. 9.

Referring initially to FIG. 1 of the drawings, there is generally shown an erected shelter 1 defining a shelter space S. The shelter 1 has a frame 2 supporting a canopy 3. The frame 2 for the shelter 1 is shown in detail in FIGS. 2 to 8, and can be erected (as shown in FIG. 2), for supporting the canopy 3 so as to form the shelter 1, and collapsed (as shown in FIG. 8) for storage of the shelter 1 when not in use. The frame 2 shown in detail in FIGS. 9 to 11 is very similar although will produce a slightly different roof appearance in the erected shelter, as will become more apparent hereinafter. The following description refers equally to the shelter frame embodiments of FIGS. 2 to 8 and FIGS. 9 to 11, unless otherwise indicated.

The frame 2 includes four legs 4 arranged at corners of a generally quadrangular frame. It will be appreciated, and become more apparent hereinafter, that other leg numbers and/or frame shapes are possible. Each leg 4 is elongate with an upper end 5 and a lower end 6. The lower ends 6 bear on ground or another support surface G when the frame 2 is erected in order to support the frame 2 and shelter thereon.

The legs 4 are adjustable in length between a full length adopted when the frame 2 is erected, and a reduced length adopted when the frame 2 is collapsed. Adjustment to the full length occurs during frame erection, and to the reduced length occurs during frame collapse.

To enable adjustment, each leg 4 includes at least two leg sections 7,8 movable relative to one another. The leg sections 7,8 of each leg 4 are telescopically interconnected for relative sliding movement one within the other in order to achieve leg length adjustment.

As shown, each leg 4 includes an upper leg section 7 providing the upper end 5, and a lower leg section 8 providing the lower end 6. The lower leg section 8 is telescopically slidable within the upper leg section 7. Each leg section 7,8 is tubular to enable that telescopic interconnection.

Each leg 4 includes a locking mechanism 9 for rigidly locking the leg sections 7,8 together when moved to the full leg length. The locking mechanism 9 is actuable to release the leg sections 7,8 for relative movement to the reduced leg length. The locking mechanisms 9 automatically lock the leg sections 7,8 together when moved to the full leg length, the mechanisms 9 being manually actuable to release the leg sections 7,8 for movement to the reduced leg length.

The locking mechanisms 9 may similarly lock the leg sections 7,8 of each leg 4 together when moved to the reduced leg length. In this way, the legs 4 will be neatly retained in their reduced length condition during storage and transportation.

The locking mechanisms 9 may be of any suitable construction, well known to those skilled in the relevant art In these embodiments, each locking mechanism 9 includes a resiliently biased detent member 10 mounted in the lower leg section 8 for indexed engagement in an aperture 11 provided in the upper leg section 7.

A perimeter support assembly 12 extends between and interconnects the legs 4. The perimeter support assembly 12 includes elongate perimeter support members 13. Each perimeter support member 13 extends between and is connected to the upper ends 5 of a respective pair of adjacent legs 4. As shown in FIGS. 2 and 9, each perimeter support member 15 lies on an eave line E extending between the upper ends 5 of the legs and defines a demarcation between the roof and side regions of the frame 1. In particular, the perimeter support members 13 do not project beneath the eave line E down the side regions of the frame 2.

Each perimeter support member 13 is pivotably connected to respective legs 4. Each connection permits pivotal movement of the interconnected leg 4 and support member 13 toward one another during frame collapse and away from one another during frame erection. That movement is in a plane containing the interconnected leg 4 and support member 13. Thus, the support members 13 and legs 4 are interconnected for pivotal movement about axes extending perpendicular to those planes, Each interconnected leg 4 and perimeter support member 13 extend generally parallel to one another in their folded position (as shown in FIG. 8), and extend outwardly away from one another in their unfolded position (as shown in FIG. 2) Each interconnected leg 4 and perimeter support 13 move through about 90° during erection and collapse of the frame 1.

In these embodiments, each support member 13 includes a support rod 14 with two sections 15 arranged end-to-end, those sections 15 being interconnected for relative pivotal movement during frame erection and collapse. The support rod sections 15 are of approximate equal length and are foldable inwardly between the legs 4 so as to draw the legs 4 together during frame collapse.

The support rod sections 15 are interconnected for limited pivotal movement between folded and unfolded positions, but otherwise are rigidly interconnected to facilitate stability of the frame 1 when erected. The pivotal movement of the rod sections 15 is about a pivot axis extending parallel to the pivot axes of the connections between the support rods 14 and legs 4. In particular, the interconnection permits relative pivoting of the rod sections 15 inwardly between the legs 4 to which they are connected in a plane containing those legs 4. That pivotal movement is through about 90°, the rod sections 15 extending co-axially of one another when unfolded (as in FIGS. 2 and 9) and generally side-by-side with one another when folded (as in FIG. 8). However, the leg sections 15 are not pivotable outwardly from between those legs 4.

In one arrangement (not shown), the peripheral support rod sections 15 are interconnected directly with one another, and connected at opposite ends directly to the upper ends 5 of the legs 4. However, in an alternative arrangement (as shown), that interconnection and connection is indirect through connection members 16. The connection members 16 include connection brackets 17 fixed to the upper ends 5 of the legs 4, with ends of the support rod 14 being pivotably connected to the respective brackets 17.

The connection members 16 also include connection links 18 extending between and pivotably connected to juxtaposed ends of respective rod sections 15 of each rod 14.

In order to retain the support rods 14 in their unfolded position during erection of the shelter frame 2, the perimeter support assembly 12 also includes elongate stabilising members 19 extending between each support rod 14 and leg 4. Those stabilising members 19 act to releasably fix the support rods 14 and legs 4 relative to one another when unfolded to achieve rigid, stable erection of the frame 2. The stabilising members 19 are actuable to release the support rods 14 and legs 4 for relative folding in order to collapse the frame 2.

Each stabilising member 19 has one end connected to a respective support rod 14 and the other end connected to an associated leg 4. The connection with the support rod 14 is with the support rod section 15 connected to the associated leg 4. The connections are movable or removable to accommodate relative movement of the support rods 14 and legs 4 for folding and unfolding.

Each stabilising member 19 includes a stabilising strut 20 pivotably connected to a respective support rod section 15. That connection is toward the rod end connected to the associated leg 4. Each stabilising strut 20 is also pivotably connected to the associated leg 4 between the upper and lower ends 5,6 of the associated leg 4, but toward the upper end 5. Those connections permit pivoting about axes extending parallel to the axes of pivot of the respective support rod 14 to which the stabilising struts 20 are connected.

The stabilising struts 20 are adjustable to accommodate the relative movement of the support rods 14 and legs 4 during folding and unfolding, to that end, the stabilising struts 20 are connected to the legs 4 for sliding movement therealong. That movement is toward and away from the upper ends 5 of the legs 4 to enable unfolding and folding of the support rods 14, respectively.

In one arrangement (not shown), the stabilising struts 20 are connected directly with the support rods 14 and legs 4. However, in an alternative arrangement (as shown), that connection is indirect through connection members 21. The connection members 21 include connection links 22 fixed to the support rod sections 15, with one end of the stabilising struts 20 being pivotably connected to the respective links 22.

The connection members 21 also include connection brackets 23 slidably mounted on the upper leg sections 7, with the other end of the stabilising struts 20 being pivotably connected thereto. As shown, one connection bracket 23 is provided on each leg 4, and the two stabilising struts 20 associated with that leg 4 are pivotably connected to the one bracket 23. In this way, sliding movement of each bracket 23 concurrently slides and pivots the two struts 20 connected thereto.

The perimeter support assembly 12 also includes locking means 24 for releasably locking the stabilising struts 20 against sliding movement along the legs 4 in order to fix the support rods 14 and legs 4 relative to one another when unfolded. That locking is between the strut connection brackets 23 and the legs 4.

The locking means 24 includes a respective locking mechanism 25 associated with each strut connection bracket 23. Each locking mechanism 25 is actuable to release the respective connection bracket 23 for sliding movement along the leg 4 during frame folding. The locking mechanisms 25 automatically lock the brackets 23 to the legs 4 when the support rods 14 and legs 4 are unfolded during erection of the frame 2. The mechanisms 25 are manually actuable to release the brackets 23 for movement in order to fold the legs 4 and support rods 14.

Each locking mechanism 25 can be of the same or similar construction to the mechanisms 9 used for locking the leg sections 7,8 together. With this arrangement, the resiliently biased detent members 26 can be mounted in the upper leg sections 7, and the apertures 27 can be provided in the connection brackets 23.

A canopy peak support assembly 28 extends outwardly from the upper ends 5 of the legs 4, when the frame 2 is erected, to define the shelter space S. The canopy peak support assembly 28 includes elongate canopy peak support members 29. Each support member 29 extends from a respective leg 4 and is interconnected with the other support members 29 remote therefrom. Each canopy peak support member 29 defines a respective canopy hip line H, whilst the interconnected ends of the support members 29 form a peak region P located centrally over the shelter space S when in the unfolded position.

Each canopy peak support member 29 is pivotably connected to the respective leg 4 and pivotably interconnected to the other support members 29. Those connections permit pivotal movement of the canopy peak support members 29 between a folded position (as shown in FIG. 8) located where they extend generally side-by-side one another below the upper ends 5 of the legs 4, and inwardly between those legs, and an unfolded position (as shown in FIGS. 2 and 9) extending above the upper ends of the legs and over shelter space S defined by the frame 2.

Each canopy peak support member 29 includes a canopy peak support rod 30 with two sections 31,32. The rod sections 31,32 are interconnected for relative pivotal movement between the folded and unfolded positions of the support rods 30.

The canopy peak support rod sections 31,32 include a lower rod section 31 having one end connected to the upper end 5 of a respective leg 4, and an upper rod section 32 having one end connected with the corresponding ends of the other upper rod sections 32. The lower and upper rod sections 31,32 each have an opposite end, with the opposite end of the lower rod sections 31 being pivotably connected to the respective upper rod sections 32 between the ends of those upper rod sections 32. That pivotal interconnection is adjacent to but spaced from the opposite end of the upper rod sections 32.

In one arrangement (not shown), the canopy peak support rods 30 are interconnected directly with one another, and connected directly to the upper ends 5 of the legs 4. However, in an alternative arrangement (as shown), those interconnections and connections are indirect through connection members 33. Thus, one end of the canopy peak support rods 30 are pivotably connected to the connection brackets 17 fixed to the upper ends 5 of the legs 4 and also used to connect the perimeter support rods 14 to the legs 4. The connection members 33 also include a peak connection bracket 34 to which the other ends of the canopy peak support rods 30 are pivotably connected, and connection links 35 fixed to the upper rod sections 32 with ends of the lower rod sections 31 being pivotably connected to the respective links 35.

In order to retain the canopy peak support rods 30 in their unfolded position, the canopy peak support assembly 28 also includes stabilising members 36 extending between each canopy peak support rod 30 and associated leg 24. Those stabilising members 36 act to releasably fix the canopy peak support rods 30 and legs 4 relative to one another when unfolded to achieve rigid, stable erection of the frame 2. The stabilising members 36 are actuable to release the support rods 30 and legs 4 for folding in order to collapse the frame 2.

Each stabilising member 36 includes a stabilising stay 37. Each stay 37 is elongate with opposed ends, one end being connected to a respective canopy peak support rod 30 and the other end being connected to an associated leg 4. Those connections permit limited pivotal movement between the stays 37, and the canopy peak support rods 30 and legs 4. The pivotal movement is about axes extending parallel to the axes of pivot of the canopy peak support rods 30.

The connection between the stabilising stay 37 and respective canopy peak support rod 30 is with the upper support rod section 32. That connection is at the opposite end of the upper rod section 32 to the ends interconnected through the peak connection bracket 34.

The connection between each stabilising stay 37 and associated leg 4 is adjacent to, but spaced from, the upper end 5. That connection is between the connections of the various support rods 14 and 30 to the legs 4, and the connection of the stabilising struts 20 to the legs 4.

The spacing of the connections of the stabilising stays 37 on the legs 4, from the upper end 5 of the legs 4, will influence the relative orientation of the canopy peak support rod sections 30 when those support rods 30 are in their unfolded positions, and also the overall stability of the shelter frame 2. In generally, as the connections are located closer to the upper end 5 of the legs 4, the canopy peak support rod sections 31,32 will tend to adopt a more axially aligned orientation so that the support rods will extend straight between the legs 4 and canopy peak connection bracket 34 (as shown in the shelter frame embodiment of FIG. 9). With this arrangement, the canopy peak support rod sections 31,32 define an included angle $\alpha$ of about 180°. The frame 2 will tend to be less rigid and stable because of the higher connection of the stabilising stays 37 to the legs 4. As the stabilising stay connections with the legs 4 are shifted further from the upper end 5 of the legs 4, the rigidity and stability of the frame 2 tends to improve. However, to accommodate that connection shift, the canopy peak support rod sections 31,32 will undergo a more limited unfolding. As a result, those support rod sections 31,32 do not axially align in their unfolded position, but rather maintain an included angle $\alpha$ of less than 180° (as shown in the shelter frame embodiment of FIG. 2). With this arrangement, the lower support rod sections 31 extend upwardly from the legs 4 at a relatively shallow angle to the horizontal, and the upper support rod sections 32 extend upwardly from the lower support rod sections 31 at a steeper angle. The final positioning of the connections of the stabilising stays 37 with the legs 4 may be selected with regard to the intended application of the shelter.

In one arrangement (not shown), the stabilising stays 37 are connected directly to the canopy peak support rods 30 and legs 4. However, in an alternative arrangement (as shown) those connections are indirect through connection members 38. Those connection members 38 include connection links 39 through which the stays 37 are pivotably connected to the canopy peak support rods 30. Those links 39 are fixed to one end of the stays 37, and pivotably connected to an opposite end of the upper support rod sections 32.

The connection members 38 also include connection brackets 40 fixed on the legs 4, the other end of the stabilising stays 37 being pivotably connected to those brackets 40. A connection bracket 40 is provided on each leg 4, and is located between the fixed connection bracket 17 at the upper end 5 of the leg 4 and the sliding connection bracket 23 for the stabilising struts 20.

Each stabilising member 36 also includes a stabilising strut 41 for retaining the respective canopy peak support rod 30 in its unfolded position. Each strut 41 is elongate with oppose ends, one end being connected to a respective stabilising stay 37, and the other end being connected to an associated leg 4. Those connections are movable or removable to accommodate relative movement of the canopy peak support rods 30, stabilising stays 37, and legs 4 for folding and unfolding.

Each stabilising strut 41 is pivotably connected to a respective stabilising stay 37. That connection is intermediate the ends of the stay 37. In these embodiments, the connection is at a distance along each stay 37 from the associated leg 4 similar to the distance of the connections of the stabilising struts 20 to the perimeter support rods 14. Each stabilising strut 41 is also pivotably connected to the associated leg 4. That connection is between the ends 5,6 of the associated leg 4 and, in these embodiments, is coincident with the connections of the stabilising struts 20 that extend from the perimeter support rods 14. Those connections permit pivoting about axes extending parallel to the axes of pivot of the respective canopy peak support rods 30 and stabilising stays 37.

In addition, the stabilising struts 41 are adjustable to accommodate the relative movement between the canopy peak support rods 30 and legs 4 during folding and unfolding. To that end, the stabilising struts 41 are connected to the legs 4 for sliding movement therealong. That movement is toward and away from the upper end 5 of the legs 4 to enable unfolding and folding of the canopy peak support rods 30, respectively.

In one arrangement (not shown), the stabilising struts 41 are interconnected directly with the stabilising stays 37 and legs 4. However, in an alternative arrangement (as shown), that connection is indirect through connection members 42. The connection members 42 include connection links 43 fixed to the stabilising stays 37, with one end of the stabilising struts 41 being pivotably connected to the respective connection links 42. In addition, the same connection brackets 23 connecting the perimeter support rod stabilising struts 20 to the legs 4 can be used for pivotably and slidably connecting the other ends of those stabilising struts 41 to the legs 4.

The legs 4, support rods 14,30, stabilising stays 37, and struts 20,41 may be manufactured by any suitable process from any suitable material, having regard to the intended application of the frame 2. In these embodiments, they may be fabricated from tubular metal stock, such as aluminium cylindrical tube. The connection brackets 17,23,34,40 and links 18,22,35,39,43 may be formed of aluminium or other metal and/or plastic material.

Returning now to FIG. 1, the shelter 1 includes the canopy 3 extending over and being supported by the frame 2. In preferred embodiments of the invention, that canopy 3 is composed of fabric or other flexible sheet material shaped to generally fit the frame 2 outline defined by the support rods 14,30.

In one preferred embodiment, the canopy 3 includes a roof section 44 formed of roof panels 45 having edges 46 which extend along the support rods 14,30 so as to define roof hip and eave lines H,E, respectively. Those roof panels 45 are generally triangular shaped, in this embodiment. Where the frame 2 is quadrangular (as shown) then four roof panels 45 will be provided, each forming a respective roof side.

The canopy 3 may also include a side section 47 formed of side panels 48 intended to depend from the roof panel edges 46, extending along the perimeter support rods 14, over those support rods 14 and about the legs 4 when the shelter 1 is erected. Those side panels 48 may include eave panels (as shown) depending from the roof panels 45 a distance which substantially covers the stabilising struts 20,41. One or more of the side panels 48 may include wall panels (not shown) which depend from the roof panels 45 to the lower ends 6 of the legs 4, and so define walls for the shelter 1.

In one embodiment (not shown for clarity purposes), the canopy 3 is permanently fitted to the frame 2. Where that occurs, the canopy 3 folds and unfolds together with the frame 2 during collapse and erection of the shelter 1. In alternative embodiments (as shown), the canopy 3 can be readily removable from the frame 2 for folding and unfolding separately from that frame 2.

In order to further understand the present invention, a procedure for collapsing the erected shelter frame 2 shown in FIG. 2 will now be outlined. It should be appreciated that this procedure can also be used to collapse the erected shelter frame 2 shown in FIG. 9. It should also be appreciated that the canopy 3 has been previously removed from the frame 2. The collapsing procedure will be carried out by a single person.

Initially, each leg 4 in turn is adjusted from its full to reduced length. That involves depressing each detent member 10 to disengage it from the aligned aperture 11 to allow the lower leg section 8 to slidingly telescope into the upper leg section 7 until the detent member 10 engages in a further aperture (not shown) locking the leg sections 7,8 together in the reduced leg length condition.

Figure 6:
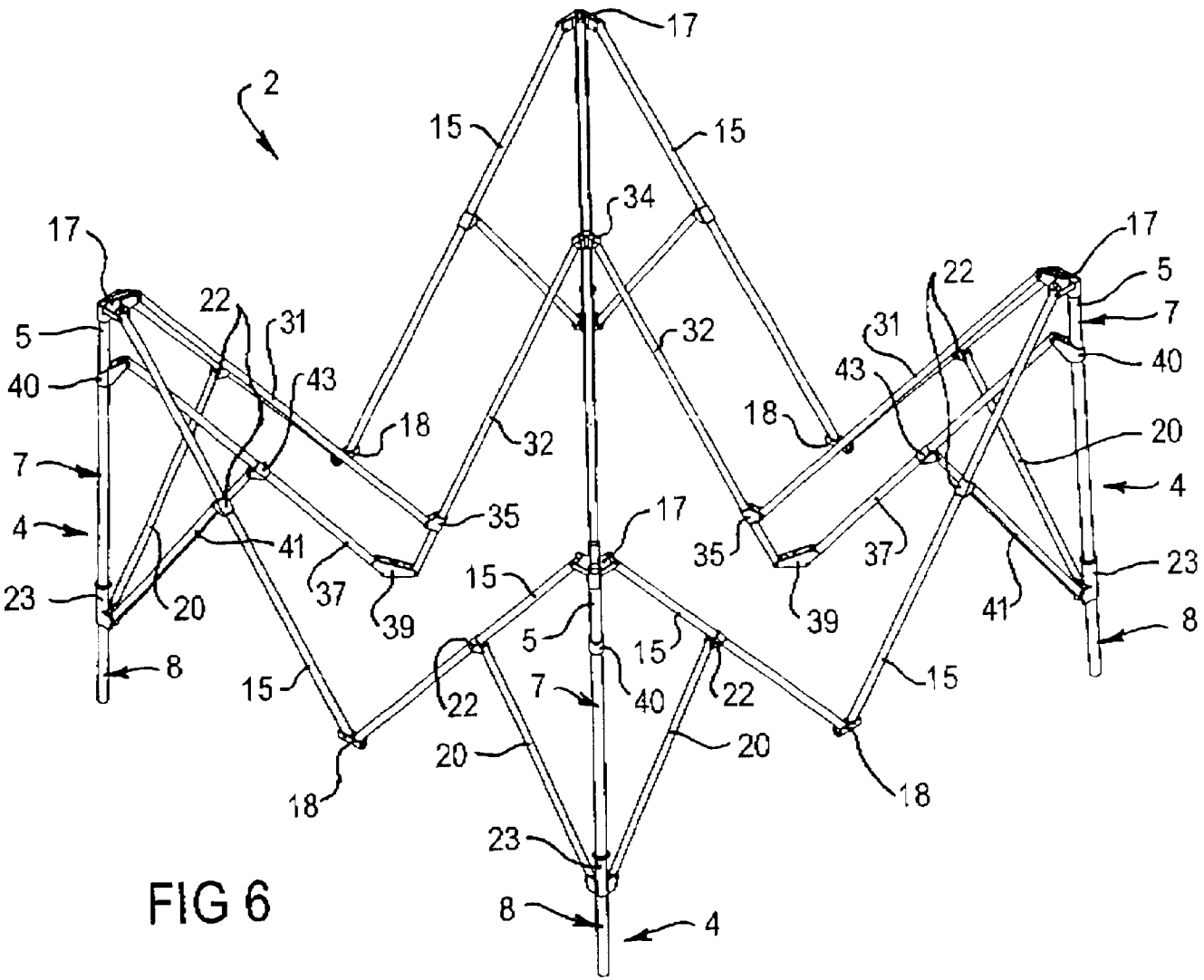
FIG. 6 is a side view of the shelter frame of FIG. 2 showing the frame partially collapsed.

Each slidable connection bracket 23 is then, in turn, unlocked from its respective leg 4 for sliding along the leg 4 away from the upper end 5 thereof. Unlocking the brackets 23 tends to cause the frame 2 to substantially collapse in a controlled and unassisted manner to a configuration as shown in FIG. 6. In particular, the canopy peak support rods 30 commence folding downwardly and inwardly between the legs 4, and the perimeter support rods 14 also fold downwardly and inwardly between the legs 4, toward their folded positions.

Figure 7:
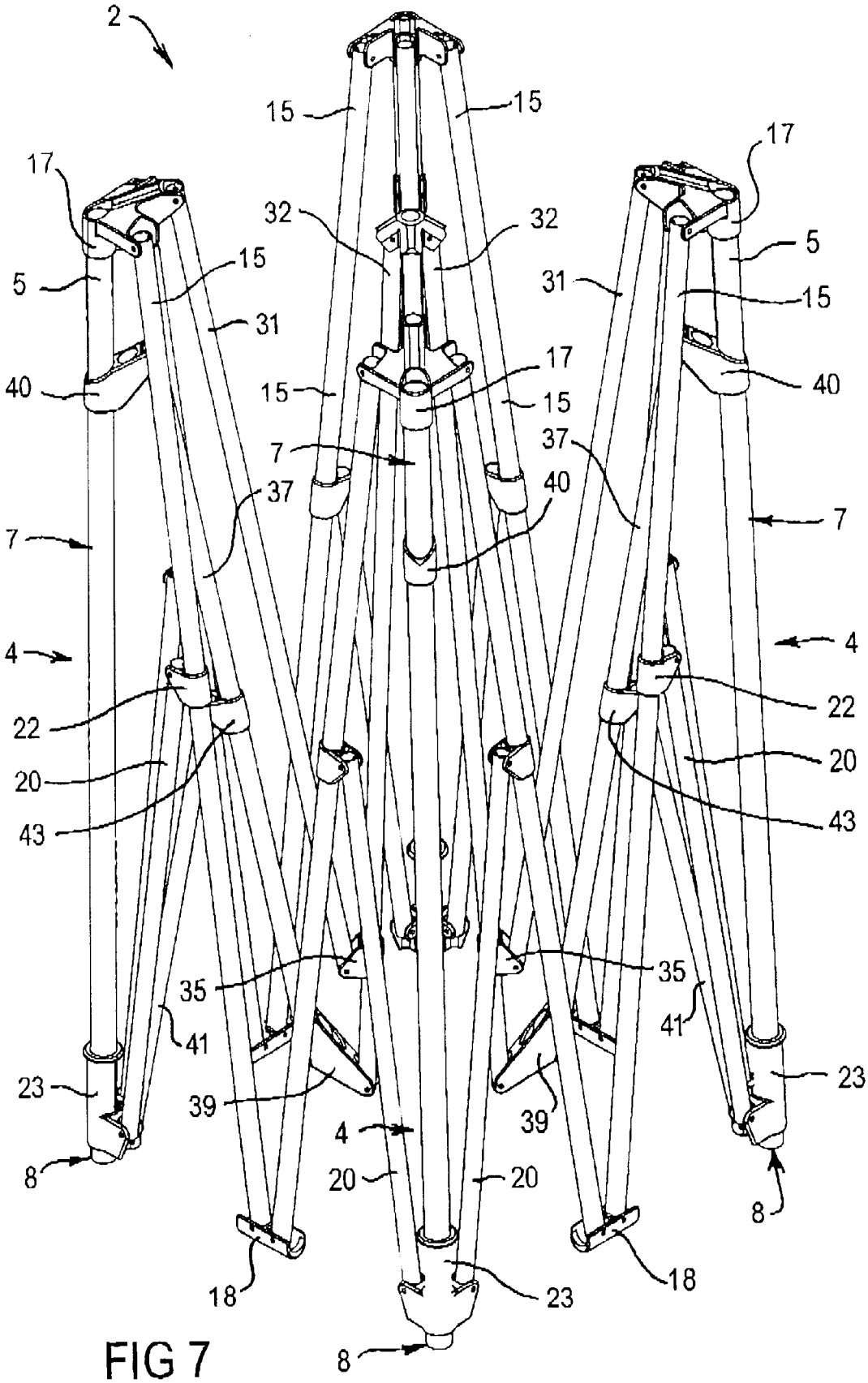
FIG. 7 is a side view of the shelter frame similar to FIG. 6 but showing the frame further collapsed.

Each leg 4 in turn is progressively moved inwardly toward a centre position of the collapsing shelter frame 2, so that the frame 2 adopts a configuration as shown in FIG. 7. During that movement, the legs 4 are maintained in a generally upright orientation. This movement of the legs 4 causes the support rods 14,30 to continue folding, and continues until all of the legs 4 are located adjacent one another at the central position of the shelter frame, as shown in FIG. 9.

In this configuration of the legs 4, the shelter frame 2 is fully collapsed. The collapsed shelter frame 2 remains standing upright unassisted on the reduced legs 4, so that a cover (not shown) can be easily slipped over the shelter frame 2 for safe storage and transportation.

It should be appreciated that erection of the shelter 1 will involve reversal of the above collapsing procedure.

Figure 12:
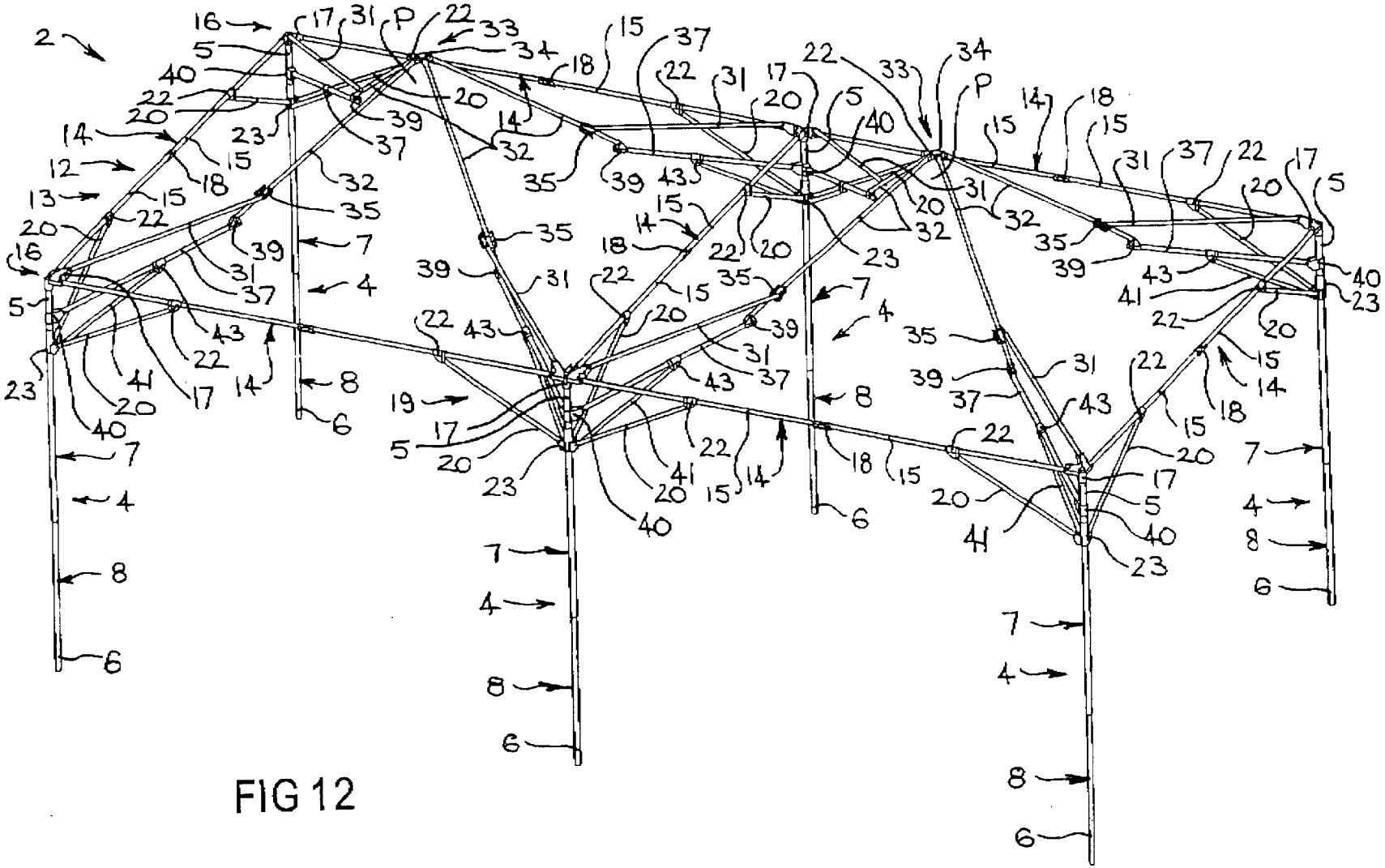
FIG. 12 is a perspective view of a shelter frame according to another embodiment of the present invention and showing the frame fully erected.

Referring to FIG. 12, there is shown a modified frame 2 having six legs arranged in an elongate quadrangular pattern, with four legs 4 located at respective corners of the frame (as in the previous embodiments) as well as two additional legs 4 located midway along respective sides of the frame 2. Elongate perimeter support members 13 extend between and are connected to respective pairs of legs 4, including between the two side legs 4. With this arrangement, the rod sections 15 are pivotably connected to the connection brackets 17 on the side legs in common with the rod sections 15 extending from the adjacent corner legs 4.

In this embodiment, the canopy peak support assembly 28 has canopy peak support members 29 extending from each leg 4 as in the previous embodiments. However, in this embodiment, two canopy peak support members 29 are associated with each of the two side legs 4. With this arrangement, one support rod 30 extends from each side leg 4 and interconnects with another, and with the support rods 30 of the members 29 extending from two adjacent corner legs 4. As a result, the canopy peak support rods 30 are interconnected in two groups by way of separate peak connection brackets 34, so as to form two peak regions P.

The canopy peak support rods 30, stabilising stays 37 and stabilising struts 41 are connected to their respective side legs 4 in common by way of connection brackets 17, 40, and 23, respectively, modified to accommodate the common connections. Otherwise, those connections are the same as between the canopy peak support rods 30, stabilising stays 37 and stabilising struts 41, and the corner legs 4.

It will be appreciated from the embodiment shown in FIG. 12, that the frame 2 may be further modified by the provision of additional legs 4 to the ends and/or sides of the frame 2 in order to support a more extensive perimeter support assembly 12 and canopy peak support assembly 28 configuration.

The shelter frame of the present invention is of relatively simple construction. The frame easily folds for rigid and stable erection, and folds for compact storage and transportation.

The perimeter support assembly of the preferred shelter frame provides good headroom access into the shelter when erected.

The shelter of the present invention is aesthetically attractive and can be readily erected and collapsed.

When erected, the shelter is easily accessible and provides clear, usable interior space.

Finally, it is to be understood that various alterations, modifications and/or additions may be made to the shelter and shelter frame without departing from the ambit of the present invention as defined in the claims appended hereto.

What is claimed is:

1. An erectable, collapsible frame for a shelter, the frame being erectable to support a canopy thereon in order to form a shelter, the frame comprising:

at least three legs;

a perimeter support assembly extending between and interconnecting adjacent legs at upper ends thereof, the perimeter support assembly being foldable and unfoldable; and a canopy peak support assembly having a canopy peak support rod associated with each leg, each canopy peak support rod having two elongate rod sections with opposed ends, one end of one rod section of each support rod being pivotably connected to the upper end of the associated leg, one end of the other rod sections being pivotable connected to one another, and the other end of the one rod section of each support rod being pivotally connected to the other rod section spaced from the other end of the other rod section, the legs and support rods being pivotable between an unfolded position in which the support rods extend above the upper ends of the legs and over shelter space defined by the frame, and a folded position in which the rod sections of the support rods and the legs extend generally side-by-side one another, wherein unfolding and folding of the legs, perimeter support assembly and the canopy peak support rods, respectively, erecting and collapsing the frame.

2. A frame as claimed in claim 1, wherein the perimeter support assembly has elongate perimeter support members, each perimeter support member extending between and being connected to a respective pair of adjacent legs, each perimeter support member lying on an eave line extending between the connections of the perimeter support members with the legs when the frame is erected.

3. A frame as claimed in claim 1, wherein the perimeter support assembly has elongate perimeter support members, each perimeter support member extending between a respective pair of adjacent legs and being connected to upper ends thereof, the perimeter support members not projecting beneath an eave line extending between the upper end connections of the perimeter support members with the legs when the frame is erected.

4. A frame as claimed in claim 2, wherein each perimeter support member is pivotably connected to the respective legs, each connection permitting pivotal movement of the perimeter support member only in a downward direction between the legs during frame collapse and only in an upward direction during frame erection.

5. A frame as claimed in claim 3, wherein each perimeter support member is pivotably connected to the respective legs, each connection permitting pivotal movement of the perimeter support member only in a downward direction between the legs during frame collapse and only in an upward direction during frame erection.

6. A frame as claimed in claim 1, wherein the perimeter support assembly has elongate perimeter support meters, each perimeter support meter extending between and being connected to a respective pair of adjacent legs, each perimeter support member has at least two sections, all of the sections of each perimeter support member being arranged end-to-end, and the sections being interconnected for relative pivotal movement for unfolding and folding during frame erection and collapse, respectively.

7. A frame as claimed in claim 6, wherein the sections of each perimeter support member are pivotably interconnected so that the sections fold inwardly between the legs connected thereto so as to draw the legs together during frame collapse.

8. A frame as claimed in claim 6, wherein each perimeter support member is a perimeter support rod having two only elongate rod sections, each rod section providing one end connected to a respective leg, and the two rod sections of each rod being interconnected end-to-end.

9. A frame as claimed in claim 8, wherein the two rod sections of each perimeter support rod are interconnected at the ends thereof for limited pivotal movement between folded and unfolded positions, the rod sections extending in co-axial alignment with one another in the unfolded position and extending generally side-by-side one another in the folded position.

10. A frame as claimed in claim 9, wherein the perimeter support assembly has connection brackets fixed to the legs, and the support rod ends are pivotably connected to respective connection brackets to pivotably connect the support rods to the legs.

11. A frame as claimed in claim 9, wherein the perimeter support assembly has connection links extending between and pivotably interconnecting the ends of respective rod section so as to permit the limited pivotal movement thereto between the folded and unfolded positions.

12. A frame as claimed in claim 1, wherein the perimeter support assembly has elongate perimeter support members, each perimeter support member extending between and being connected to a respective pair of adjacent legs, and stabilising members extending between and connected to the perimeter support members and legs to releaseably fix the support members and legs relative to one another when unfolded to achieve rigid, stable erection of the frame, the stabilising members being actuable to release the support members and legs for relative folding in order to collapse the shelter.

13. A frame as claimed in claim 12, wherein each stabilising member is elongate with opposed ends, one end being connected to a respective perimeter support member and the other end being connected to an associated leg beneath the connection of the perimeter support member with the leg so as to fix the support members relative to the legs, the connections being movable or removable to accommodate relative movement of the perimeter support members and legs for folding and unfolding.

14. A frame as claimed in claim 13, wherein each perimeter support member is a perimeter support rod having two elongate rod sections, each rod section providing one end connected to a respective leg and the two rod sections of each rod being interconnected end-to-end, each stabilising member has a stabilising strut, each stabilising strut being pivotably connected to a respective perimeter support rod section and an associated leg.

15. A frame as claimed in claim 14, wherein the stabilising struts are connected to the legs for sliding movement therealong, the movement being toward and away from the connections of the perimeter support rods with the legs during unfolding and folding of the perimeter support rods, respectively.

16. A frame as claimed in claim 15, wherein the perimeter support assembly has connection brackets slidably mounted on the legs, the other ends of the stabilising struts being pivotably connected to the connection brackets so as to connect the stabilising struts to the legs for pivotal and sliding movement relative thereto.

17. A frame as claimed in claim 15, wherein the perimeter support assembly has locking means, for releasably locking the stabilising struts against sliding movement along the legs in order to fix the perimeter support rods and legs relative to one another when unfolded.

18. A frame as claimed in claim 17, wherein the locking means has a respective locking mechanism associated with each connection bracket, each locking mechanism being actuable to release the respective connection bracket for sliding movement along the leg during frame folding.

19. A frame as claimed in claim 18, wherein each locking mechanism has a resiliently biased detent member mounted in a respective leg, and an aperture in the connection bracket slidable on the leg, the detent members being biased into the respective apertures to lock the connection brackets to the legs when the perimeter support rods and legs are unfolded during erection of the frame, the locking mechanism being manually actuable to remove the detent members against the bias our of the apertures and thereby release the connection brackets for sliding movement along the legs during frame collapse.

20. A frame as claimed in claim 1, wherein the rod sections are interconnected for limited pivotal movement between folded and unfolded positions, the rod sections extending in co-axial alignment with one another in the unfolded position and extending generally side-by-side one another in the folded position.

21. A frame as claimed in claim 1, wherein the rod sections are interconnected for limited pivotal movement between folded and unfolded positions, the rod sections extending at an included angle of less that 180° to one another in the unfolded position and extending generally side-by-side one another in the folded position.

22. A frame as claimed in claim 1, wherein the canopy peak support assembly has a peak connection bracket to which all of the other ends of the canopy peak support rods are pivotably connected in order to pivotably interconnect the canopy peak support rods.

23. A frame as claimed in claim 1, wherein the canopy peak support assembly has stabilising members extending between each canopy peak support rod and the associated leg to releasably fix the canopy peak support rods and legs relative to one another when unfolded to achieve rigid, stable erection of the frame, the stabilising members being actuable to release the canopy peak support members and legs for folding in order to collapse the frame.

24. A frame as claimed in claim 23, wherein the stabilising members have a respective elongate stabilising stay extending between each canopy peak support member and the associated leg, each stabilising stay having opposed ends, one end being connected to a respective canopy peak support member and the other end being connected to the associated leg, the connections permitting limited pivotal movement between the stabilising stays, the canopy peak support members and the legs during folding and unfolding.

25. A frame as claimed in claim 1, wherein the canopy peak support assembly has elongate stabilising stays extending between each canopy peak support rods and legs relative to one another when unfolded to achieve rigid, stable erection of the frame, the stabilising stays being actuable to release the canopy peak support rods and legs for folding in order to collapse the frame, each stabilising stay having opposed ends, one end being pivotably connected to a respective other support rod section at the other end thereof, and the other end being pivotably connected to the associated leg adjacent to but spaced beneath the upper end thereof, the connections permitting limited pivotal movement between the stabilising stays, the canopy peak support rods and the legs during folding and unfolding.

26. A frame as claimed in claim 25, wherein the canopy peak support assembly has connection links pivotably connecting the stabilising stays to the other canopy peak support rod sections.

27. A frame as claimed in claim 26, wherein the connection links are fixed to one end of the stabilising stays and pivotably connected to the opposite ends of the other canopy peak support rod sections.

28. A frame as claimed in claim 25, wherein the canopy peak support assembly has connection brackets fixed on the legs, the one end of the one canopy peak rod sections being pivotably connected to the rackets so as to pivotably connect the canopy peak support rods to the legs.

29. A frame as claimed in claim 1, wherein at least three legs are provided, the legs being located as respective ones of four corners of the frame when erected.

30. A frame as claimed in claim 29, wherein at least two additional legs are provided, the additional legs being located on respective opposite sides of the frame when erected.

31. An erectable, collapsible shelter comprising:

a frame as claimed in claim 1;

a canopy extending over and supported by the perimeter and canopy peak support assemblies when the shelter is erected.

32. An erectable, collapsible frame for a shelter, the frame being erectable to support a canopy thereon in order to form a shelter, the frame comprising:

at least three legs;

a perimeter support assembly extending between and interconnecting adjacent legs at upper ends thereof, the perimeter support assembly including:

(i) one only perimeter support rod extending between each pair of legs, each perimeter support rod having two elongate rod sections arranged end-to-end, one end of each rod section being pivotably connected to a respective leg and the other end of the rod sections of each perimeter support rod being pivotably connected to one another, the legs and support rods being pivotable between an unfolded position in which the support rods extend on an eave line between the upper ends of the legs, and a folded position in which the rods sections of the support rods and the legs extend generally side-by-side one another, and (ii) a respective stabilising strut extending between each support rod section and an associated leg, each stabilising strut having opposed ends, one end being connected to the respective support rod section and the other end being connected to the associated leg beneath the upper end thereof, the stabilising struts releasably fixing the perimeter support rods and legs relative to one another in their unfolded position, and being actuable to release the support rods and legs for folding into their folded position; and a canopy peak support assembly including:

(i) a canopy peak support rod associated with each leg, each canopy peak support rod having two elongate rod sections with opposed ends, one end of one rod section of each support rod being pivotably connected to the upper end of the associated leg, one end of the other rod sections being pivotably connected one to another, and the other end of the one rod section of each support rod being pivotably connected to the other rod section between the ends of the other rod section, the legs and support rods being pivotable between an unfolded position in which the support rods extend above the upper ends of the legs and over shelter space defined by the frame, and a folded position in which the rods sections of the support rods and the legs extend generally side-by-side on another;

(ii) a respective stabilising stay extending between each canopy peak support rod and the associated leg, each stabilising stay having opposed ends, one end being connected to the associated leg and the other end being connected to the other end of the other rod section of the canopy peak support rod; and (iii) a respective stabilising strut extending between each stabilizing stay and the associated leg, each stabilising strut having opposed ends, one end being connected to the associated leg and the other end being connected to the stabilising stay intermediate the ends thereof, the stabilising struts releasably fixing the canopy peak support rods, stabilising stays, and legs relative to one another in their unfolded position, and being actuable to release the canopy peak support rods and legs for folding into their folded position, wherein unfolding and folding of the legs, perimeter support assembly and the canopy peak support rods, respectively, erecting and collapsing the frame.

33. And erectable, collapsible shelter comprising:

a frame as claimed in claim 32; and a canopy extending over and supported by the perimeter and canopy peak support assemblies when the shelter is erected.

34. An erectable, collapsible frame for a shelter, the frame being erectable to support a canopy thereon in order to form a shelter, the frame comprising:

at least three legs;

a perimeter support assembly extending between and interconnecting adjacent legs at upper ends thereof, the perimeter support assembly being foldable and unfoldable; and a canopy peak support assembly having:

elongate canopy support members with opposed ends, one end of each canopy peak support member being connected to an associated leg and the other end being interconnected with at least one other canopy support member, the legs and canopy peak support members being movable between an unfolded position in which the support members extend above the legs and over shelter space defined by the frame, and a folded position in which the support members and the legs extend generally side-by-side one another;

a respective stabilising stay extending between each canopy peak support member and the associated leg, each stabilising stay having opposed ends, one end being connected to a respective canopy peak support member and the other end being connected to the associated leg; and a respective stabilising strut extending between each stabilising stay and the associated leg, each stabilizing strut having opposed ends, one end being connected or connectable to a respective stabilising stay, and the other end being connected or connectable to the associated leg;

the stabilising stays and struts releasably fixing the canopy peak support members and legs relative to one another in their unfolded position, and being actuable to release the canopy peak support members and legs for folding into their folded position, wherein unfolding and folding of the legs, perimeter support assembly and the canopy peak support members, respectively, erecting and collapsing the frame.

35. A frame as claimed in claim 34, wherein each stabilising strut is pivotably connected to the respective stabilising stay intermediate the ends of the stabilising stay.

36. A frame as claimed in claim 34, wherein each stabilising strut is pivotably connected to the associated leg.

37. A frame as claimed in claim 36, wherein the stabilising struts are connected to the legs for sliding movement therealong, the movement being toward and away from the connections of the canopy peak support members with the legs during folding and unfolding, respectively.

38. A frame as claimed in claim 37, wherein the canopy peak support assembly includes connection brackets slidably mounted on the legs, the other ends of the stabilising struts being pivotably connected to the connection brackets so as to connect the stabilising struts to the legs for pivotal and sliding movement relative thereto.

39. A frame as claimed in claim 34, wherein each leg has at least two leg sections movable relative to one another between a full length condition adopted when the frame is erected, and a reduced length condition adopted when the frame is collapsed.

40. A frame as claimed in claim 39, wherein the leg sections of each leg are telescopically interconnected for relative sliding movement one within an other in order to adjust the leg length.

41. A frame as claimed in claim 40, wherein each leg has a looking mechanism for rigidly locking the leg sections together when moved to the full length condition, the mechanisms being actuable to release the leg sections for relative movement to the reduced leg length condition.

42. A frame as claimed in claim 41, wherein each locking mechanism has a resiliently biased detent member mounted in one leg section, and an aperture in the other leg section, the detent members being biased into the respective apertures to lock the leg sections together when moved to the full leg length condition, the mechanisms being manually actuable to move the detent members against the bias out of the apertures and thereby release the leg section for relative sliding movement to the reduced leg length condition.

* * * * *